US007322735B1

(12) United States Patent
Caldani

(10) Patent No.: US 7,322,735 B1
(45) Date of Patent: Jan. 29, 2008

(54) TELESCOPING POWER MEDIUM

(75) Inventor: Nelson Caldani, Wadsworth, IL (US)

(73) Assignee: Minka Lighting, Inc., Corona, CA (US)

( * ) Notice: Subject to any disclaimer, the term of this patent is extended or adjusted under 35 U.S.C. 154(b) by 4 days.

(21) Appl. No.: 11/706,160

(22) Filed: Jul. 21, 2006

(51) Int. Cl.
*F21S 8/04* (2006.01)

(52) U.S. Cl. ..... 362/648; 362/285; 362/418

(58) Field of Classification Search ..... 362/648, 362/285, 418, 419, 147
See application file for complete search history.

(56) References Cited

U.S. PATENT DOCUMENTS 2,473,218 A * 6/1949 Reichenbach ..... 248/411
4,258,413 A 3/1981 Mausser
5,012,394 A 4/1991 Woodward
5,761,550 A * 6/1998 Kancigor ..... 396/176
6,244,733 B1 6/2001 Fong et al.
D507,840 S 7/2005 Chan
7,017,871 B2 * 3/2006 Chen ..... 248/161
2003/0095411 A1 * 5/2003 Blackwelder ..... 362/385

OTHER PUBLICATIONS

Displayit Internet Catalog; Model #lf001; printed from www.exhibitstogo.com, 2006.
Exhibit solutions of New Mexico Internet Catalog; Display and Exhibit Lighting; printed from www.exhibitsolutionsnm.net, 2006.

* cited by examiner

*Primary Examiner*—Laura Tso
(74) *Attorney, Agent, or Firm*—Baker & McKenzie, LLP

(57) ABSTRACT

A telescoping power medium which can be telescopically positioned at any one of several distances and has an outer collapsible conductor surrounding an inner collapsible conductor. For example, a telescoping light fixture arm, the arm being adapted to electrically connect a lighting track to a light fixture.

13 Claims, 1 Drawing Sheet

TELESCOPING POWER MEDIUM

PRIOR RELATED APPLICATIONS

Not applicable.

FEDERALLY SPONSORED RESEARCH STATEMENT

Not applicable.

REFERENCE TO MICROFICHE APPENDIX

Not applicable.

FIELD OF THE INVENTION

The invention relates to a telescoping power medium. The invention is further directed to a light fixture that has a telescoping arm.

BACKGROUND OF THE INVENTION

Track or rail lighting fixtures suspended from ceilings are usually hung from the track via fixed length lighting fixtures. Once attached, if the height of the light fixture is to be adjusted, the lighting fixture must be removed and a new lighting fixture of a different height must be placed on the track, assuming the consumer has multiple fixed length lighting fixtures available. The inconvenience of disassembling the light fixture, changing the light fixture and reattaching the light fixture to the track warrants a mechanism that would simplify the adjustment of the height of the light fixture. This inconvenience would also be applicable to any situations where a power medium provides power remotely from the power source.

Some track lighting fixtures do not allow the light source to be directed in more than one direction for the purposes of art or trade displays. The ability to direct light from either the base of the light fixture or the light fixture would be advantageous to those in the lighting arts. To be able to tilt, swivel or pivot the light without moving the track and/or fixtures would make it easier to set up and break down displays.

Current track lighting telescoping fixtures utilizes two arms wherein each arm acts as a conductor, or a single arm acting as one conductor, and an external or internal wire acting as a second conductor. The use of two arms minimizes design and aesthetic flexibility. The use of either an internal or external wire complicates or prevents telescoping ability.

SUMMARY OF THE INVENTION

Embodiments of the invention include a telescoping power medium having a first end and a second end. The first end of the medium is attached to a power source and the second end of the medium is attached to a power receiver. The telescoping power medium can be telescopically positioned at any one of several distances and has an outer collapsible conductor surrounding an inner collapsible conductor.

A preferred embodiment is a light fixture having a lighting track; a base coupled to the lighting track; a lamp housing coupled to the base; and a telescoping arm. The arm has a first end attached to the base and a second end attached to the lamp housing. The telescoping arm allows the lamp housing to be telescopically positioned at any one of several distances from the base. The telescoping arm comprises an outer collapsible conductor surrounding an inner collapsible conductor. The lamp housing may pivot from 0 to 90 degrees relative to the telescoping arm. The lamp housing may be 360 degrees rotatable around the axis of the base. The outer collapsible conductor may be a conductive material or a low voltage material. The inner collapsible conductor may be a conductive material, such as but not limited to, aluminum, tin, copper, steel, or any alloy. In a preferred embodiment, the inner collapsible conductor is brass. There may be insulation between the inner collapsible conductor and the outer collapsible conductor. The lighting track supplies power to the light housing via the base and the telescoping arm. The lamp housing also includes a light bulb which may be a line voltage, low voltage incandescent, halogen, xenon, fluorescent, metal halide, high and low pressure sodium or LED bulb.

An alternative embodiment is a telescoping light fixture arm having a first end and a second end. The first end of the arm is adapted to electrically connect to a lighting track and the second end of the arm is adapted to electrically connect to a lamp housing. The arm comprises an outer collapsible conductor surrounding an inner collapsible conductor. The telescoping arm allows the lamp housing to be telescopically positioned at any one of several distances from the base.

DESCRIPTION OF EMBODIMENTS OF THE INVENTION

Figure 1:
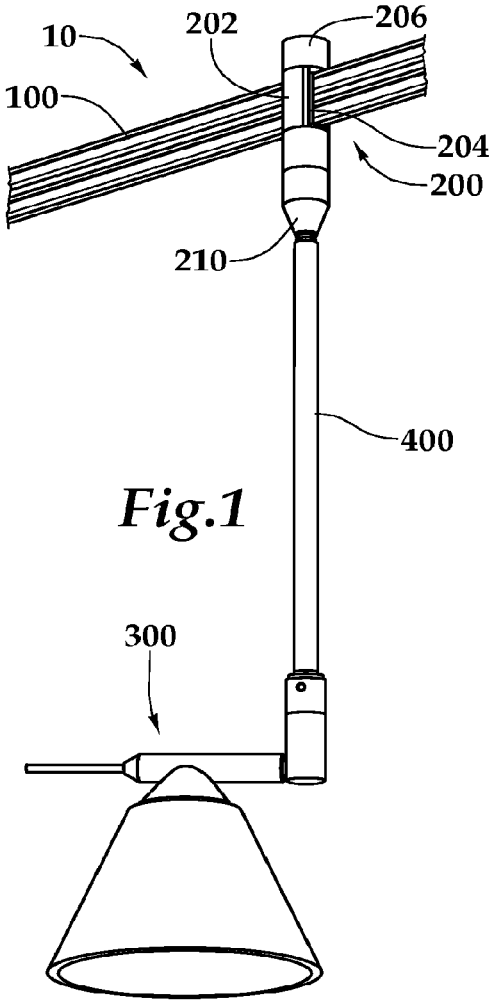
FIG. 1 is a schematic view of a telescoping light fixture in the non-extended position.

Referring now to the drawings, there is shown one embodiment of the present invention illustrated as a telescoping light fixture on a track light. The light fixture 10 generally comprises a track 100, a base 200 coupled to the track 100, and a lamp housing 300 secured to the base 200 via telescoping arm 400. In some embodiments, there may be a plurality of bases 200 coupled to the track 100. Preferably base 200 is slidably coupled to track 100.

The track 100 is any track lighting that can be adapted to electrically connect with the base 200. In some embodiments, the track 100 is a rail. In alternate embodiments, the track 100 conducts low voltage or line voltage current. In alternative embodiments, the track 100 may be a rail lighting system.

The base 200 includes a split adapter housing 202 having a slot 204 formed therein adapted to receive the track 100. The base 200 also includes a threaded portion (not shown) which receives support cap 206. The support cap 206 closes an open end of slot 204. Although the combination of a split adapter housing 202 and a support cap 206 is illustrated as connecting the base 200 to the track 100, other methods of connecting the base 200 to the track 100 are contemplated as being included in the present invention, and include without limitation, screws, rivets, mechanical fasteners, snap and twist fixtures, and the like. In an alternate embodiment, the base 200 may be coupled to the track via a plurality of conductors.

Figure 2:
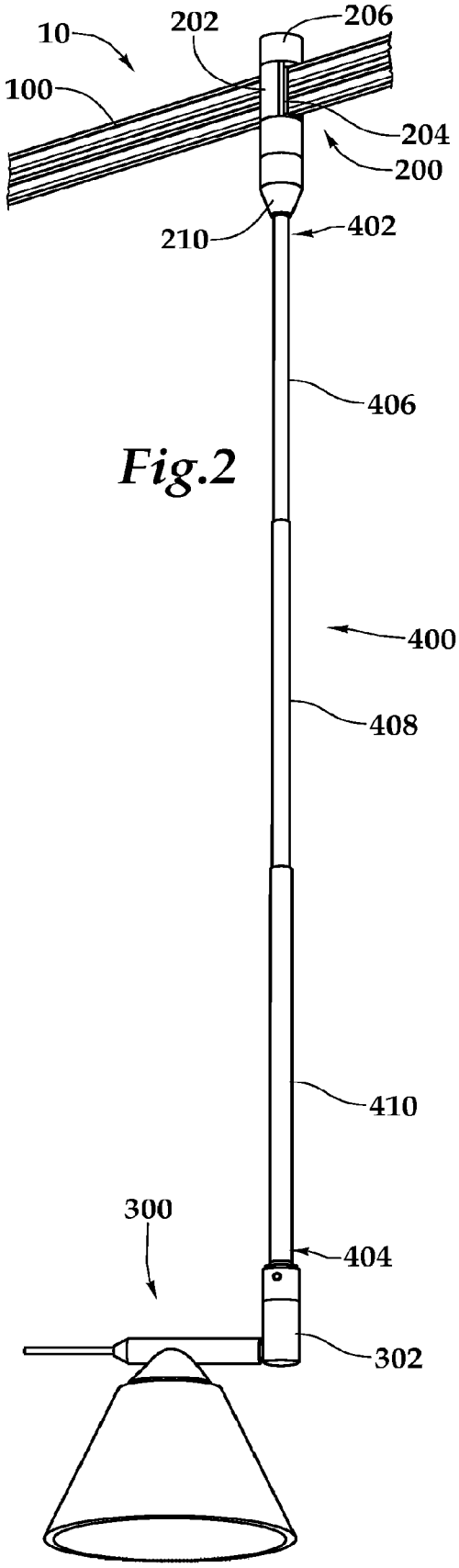
FIG. 2 is a schematic view of the telescoping light fixture of FIG. 1 in the extended position.

The base 200 may also include a mounting section 208, which has a yoke 210 rotatably mounted therein. Preferably, the yoke 210 is rotatable 360 degrees about the axis of the base 200. The yoke 210 is also coupled to the telescoping arm 400. The telescoping arm 400 has a first end 402 and a second end 404. The yoke 210 is connected to the first end 402 of the telescoping arm 400. The lamp housing 300 is pivotally connected to the second end 404 of the telescoping arm 400. The lamp housing 300 includes a pivot bracket 302 for positioning the lamp housing 300 from about 0 to about 90 degrees perpendicular to the axis of the telescoping arm 400. FIGS. 1 and 2 show the lamp housing about 90 degrees perpendicular to the axis of the telescoping arm 400. In other embodiments, the pivot bracket 302 has a range from about 0 to about 180 degrees along the axis of the telescoping arm 400. The lamp housing 300 also has a lamp socket mounted therein (not shown). This lamp socket may be for a line voltage or low voltage incandescent, halogen, xenon, fluorescent, metal halide, high and low pressure sodium and LED bulbs. Although the pivot bracket 302 is illustrated as connecting the lamp housing 300 to the telescoping arm 400, other methods of pivotally connecting the lamp housing 300 to the telescoping arm 400 are contemplated as being included in the present invention, and include without limitation, screws, rivets, mechanical fasteners, snap and twist fixtures, and the like.

In a preferred embodiment, the telescoping arm 400 includes a plurality of collapsible conductor sections. Preferably, there is a first conductor section 406, a second conductor section 408 and a third conductor section 410. The collapsing conductor sections are telescopically connected to each other. In an alternate embodiment, the collapsible conductor sections are connected via internal spring loaded wiring. Although cylindrical conductors are described, other shapes of nesting conductors are envisioned, such as, but not limited to, square or rectangular. In alternate embodiments, the conductors are not nested, but are slidably connected to each other in a side-by-side fashion. Each of the collapsing conductor sections are composed of a plurality of cylindrical conductors. Each of the collapsing conductor sections has an inner conductor cylinder and an outer conductor cylinder. In a preferred embodiment, there is insulation between the inner conductor cylinder and the outer conductor cylinder. In a further preferred embodiment, there are no wires running inside or along the collapsing conductor sections. The inner conductor cylinder may be made of a conductive metal or a conductive material. The inner collapsible conductor may be a conductive material, such as but not limited to, aluminum, tin, copper, steel, or any alloy. In a preferred embodiment, the inner conductor cylinder is constructed of brass. In a preferred embodiment, the outer conductor cylinder is a low voltage conductor and may be made of any suitable material. In an alternate embodiment, the outer conductor may be a high voltage conductor with insulation or a line voltage conductor and may be made of any suitable material. The telescoping arm 400 may be linear or capable of curvature. Since each of the collapsing conductor sections 406, 408, and 410 remain in intimate electrical contact with adjacent sections, the electric circuit between the track 100, and the lamp housing 300 also remains intact and allows the lamp to light. Power to the track is supplied by any known manner known to one skilled in the art. During operation of the light fixture 10, electrical current is supplied from the track 100 and enters the lamp housing through the base 200. The current proceeds to travel through the telescoping arm via the internal telescoping conductor and enters the lamp housing 300 where it proceeds to the bulb. The current then exits the lamp housing 300 and back into the telescoping arm 400 via the outer telescoping conductor and back into the track 100. The current may be high, low or line voltage.

In alternate embodiments, there are a plurality of lamp housings 300. The lamp housings 300 may be positioned at any location along the tracks simply by removing the support caps and disengaging the base from the track. In as much as the voltage operating through the track is of low voltage of about 12 volts, or other low voltage, it is possible for a person who does not have any training as an electrician to move the lamps or to add lamps without the risk of electrocution. The low voltage is safe for even those who are not experienced in electrical matters. In an alternate embodiment, the voltage operating through the tracks is of high or regular voltage, such as that used for typical track or rail lighting fixtures. Low voltage is as described by the National Electric Code (NEC) section 411 as being 30 VAC or less and limited to 25 AMPS.

The base 200 is mounted on the track 100 by placing the track 100 into slot 204, then screwing support cap 206 onto the threaded portion to lock the track 100 into the base 200. Contacts (not shown) within the base 200 are in electrical connection with the respective conductors of the track 100. A bulb is mounted in the lamp housing 300 to be energized by the voltage current flowing in the track. The bulb may be a line voltage or low voltage incandescent, halogen, xenon, fluorescent, metal halide, high and low pressure sodium and LED bulb. The inner and outer conductor cylinders are in electrical connection with the lamp housing so as to supply current to the lamp when the lamp is mounted in the lamp housing.

Although a telescoping light fixture is shown in the drawings, an alternative embodiment is a telescoping power medium that includes a plurality of collapsible conductor sections. The collapsing conductor sections would be telescopically connected to each other. In some embodiments, the collapsible conductor sections are connected via internal spring loaded wiring. Each of the collapsing conductor sections are composed of a plurality of cylindrical conductors. Although cylindrical conductors are described, other shapes of nesting conductors are envisioned, such as, but not limited to, square or rectangular. Although nesting of the conductors is described, it is envisioned that the conductors are telescopically coupled in a side-by-side fashion. Each of the collapsing conductor sections has an inner conductor cylinder and an outer conductor cylinder. In a preferred embodiment, there is insulation between the inner conductor cylinder and the outer conductor cylinder. In a further preferred embodiment, there are no wires running inside or along the collapsing conductor sections. The inner conductor cylinder may be made of a conductive metal or a conductive material. The inner collapsible conductor may be a conductive material, such as but not limited to, aluminum, tin, copper, steel, or any alloy. In a preferred embodiment, the inner conductor cylinder is constructed of brass. In a preferred embodiment, the outer conductor cylinder is a low voltage conductor and may be made of any suitable material. In an alternate embodiment, the outer conductor is a high voltage conductor with insulation and may be made of any suitable material. The telescoping power medium may be linear or capable of curvature. Since each of the collapsing conductor sections remain in intimate electrical contact with adjacent sections, the electric circuit between the sections also remains intact and allows the power to transmit through the sections. Power to the sections is supplied by any known manner known to one skilled in the art. During operation of the power medium, electrical current is supplied from a power source, such as but not limited to a transformer, and travels through the telescoping sections via the internal telescoping conductor. The current proceeds to an electrically powered device, for example a light fixture. The current then exits the electrically powered device through the telescoping section via the outer telescoping conductor and back into the power source. The current may be high, low or line voltage.

Although a one-to-one relationship between the base, telescoping arm and light fixture is shown, multiple bases, multiple telescoping arms and multiple light fixtures are also envisioned. For example, a plurality of bases attached to a light fixture by an equal plurality of telescoping arms. Although a one-to-one relationship between telescoping power mediums, a power source and an is shown, multiple telescoping power mediums, multiple power sources arms and multiple electrically powered devices are also envisioned. For example, a plurality of power mediums attached to an electrically powered device by an equal plurality of power sources.

It is thus believed that the operation and construction of the present invention will be apparent from the foregoing description of a preferred embodiment. While the device shown is described as being preferred, it will be obvious to a person of ordinary skill in the art that various changes and modifications may be made therein without departing from the spirit and scope of the invention as defined in the following claims. For example, the telescoping sections may be used as the track or rail. Therefore, the spirit and scope of the appended claims should not be limited to the description of the preferred embodiment contained herein.

What is claimed is:

1. A light fixture, comprising, a. a lighting track;

b. a base coupled to the lighting track;

c. a lamp housing coupled to the base; and d. a telescoping arm, the arm having a first end and a second end, the first end of the arm being attached to the base and the second end of the arm being attached to the lamp housing, wherein the telescoping arm allows the lamp housing to be telescopically positioned at any one of several distances from the base and wherein the telescoping arm comprises an outer collapsible conductor surrounding an inner collapsible conductor.

2. The light fixture of claim 1, wherein the lamp housing is pivotable from 0 to 90 degrees relative to the telescoping arm.

3. The light fixture of claim 1, wherein the lamp housing is 360 degrees rotatable around the axis of the base.

4. The light fixture of claim 1, wherein the outer collapsible conductor comprises a conductive material.

5. The light fixture of claim 1, wherein the outer collapsible conductor comprises a low voltage material.

6. The light fixture of claim 1, wherein the inner collapsible conductor comprises a conductive material.

7. The light fixture of claim 6, wherein the inner collapsible conductor is brass, aluminum, tin, copper, steel, or an alloy.

8. The light fixture of claim 1, further comprising insulation between the inner collapsible conductor and the outer collapsible conductor.

9. The light fixture of claim 1, wherein the lighting track supplies power to the light housing via the base and the telescoping arm.

10. The light fixture of claim 1, wherein the lamp housing further comprises a light bulb.

11. The light fixture of claim 10, wherein the light bulb is a line voltage, low voltage incandescent, halogen, xenon, fluorescent, metal halide, high and low pressure sodium or LED bulb.

12. The light fixture of claim 1, wherein the outer collapsible conductor and the inner collapsible conductor conducts high, low or line voltage.

13. A telescoping light fixture arm, the arm having a first end and a second end, the first end of the arm being adapted to electrically connect to a lighting track and the second end of the arm being adapted to electrically connect to a lamp housing, wherein the arm comprises an outer collapsible conductor surrounding an inner collapsible conductor and wherein the telescoping arm allows the lamp housing to be telescopically positioned at any one of several distances from the base.

* * * * *